US006027317A

United States Patent [19]

Barthod et al.

[11] Patent Number: 6,027,317

[45] Date of Patent: Feb. 22, 2000

[54] SCROLL TYPE MACHINE

[75] Inventors: Benoît Barthod, Naves-Parmelan; Jean-Pierre Chicherie, *deceased, late of Annecy-le-Vieux, by Mireille Chicherie, legal representative*; Patrick Philippe, Annecy, all of France

[73] Assignee: Alcatel, Paris, France

[21] Appl. No.: 09/090,148

[22] Filed: Jun. 4, 1998

[30] Foreign Application Priority Data

Jun. 5, 1997 [FR] France ..... 97 06965

[51] Int. Cl.[7] ..... F04C 18/02

[52] U.S. Cl. ..... 417/410.5; 418/55.1

[58] Field of Search ..... 417/410.5; 418/55.1

[56] References Cited

U.S. PATENT DOCUMENTS

| | | | |
|---|---|---|---|
| 4,677,949 | 7/1987 | Youtie . | |
| 5,531,577 | 7/1996 | Hayase et al. | 418/55.1 |
| 5,624,243 | 4/1997 | Omodaka et al. | 417/366 |
| 5,961,306 | 10/1999 | Noboru et al. | 418/55.1 |

FOREIGN PATENT DOCUMENTS

| | | |
|---|---|---|
| 2141402 | 1/1973 | France . |
| 1210922 | 3/1990 | France . |
| 2736999A1 | 1/1997 | France . |
| 2225327 | 12/1972 | Germany . |
| 11-50980 | 2/1992 | Japan . |

*Primary Examiner*—Charles G. Freay
*Assistant Examiner*—David J. Torrente
*Attorney, Agent, or Firm*—Sughrue, Mion, Zinn, Macpeak & Seas, PLLC

[57] ABSTRACT

A scroll type machine including a fixed disk (5) comprising a spiral working wall (6) and a mobile disk (7) equally comprising a spiral working wall (8) cooperating with that of the fixed disk, means for driving circular translation movement of the mobile disk, a sealing bellows (15) joined at one end to a member (14) fixed with respect to the circular translation movement of the mobile disk (7) and at its other end to a fixed part (1C) of the machine, said bellows (15) separating the fluid circuit from the mechanical parts driving the mobile disk, characterized in that the fixed disk (5) is joined on the side opposite the mobile disk (7) to a fixed central shaft (10) including a discharge passage (11), said central shaft being surrounded by said bellows (15), the space (16) between said bellows and said fixed central shaft constituting a suction passage, in that a hollow main rotary shaft (19) surrounds said bellows (15) and is carried by at least one bearing (23, 24–32) in a fixed frame (1), one end of said main shaft (19) including an eccentric circular bore (18) cooperating with a drive member (14) joined to the mobile disk (7), said drive means including an electric motor rotor (25) joined to said main rotary shaft (19) and surrounding it and a fixed stator (26) surrounding said rotor.

8 Claims, 3 Drawing Sheets

SCROLL TYPE MACHINE

The present invention concerns a scroll type machine.

In particular, the invention applies to scroll type machines operating as vacuum pumps but equally suitable for pumping liquids or for use as a compressor.

The aim of the invention is to provide as compact a machine as possible with an absolute seal between the mechanical parts and the fluid circuits.

Document EP 0 728 947 describes a scroll type machine including a fixed disk equipped with a spiral and a mobile disk equipped with a spiral and moving in circular translation in which the seal between the fluid circuit and the mechanical drive parts is provided by a bellows joined at one end to a fixed part of the machine and at the other end to the mobile disk moving in circular translation. In this machine the drive motor is at the end, which considerably increases the length of the machine, and the sealing bellows is subjected to torsion forces.

U.S. Pat. No. 3,817,664 also describes a machine of this kind which also has a sealing bellows that is equally subject to torsion forces and here the drive system again greatly increases the length of the machine.

Document EP 0 428 729 describes a much more compact machine, however: there is no output shaft driven by a motor, the latter being disposed inside the casing of the machine. In this machine both disks are rotated and each is equipped with a spiral. One of them, the drive disk, is driven by the motor integrated into the casing and the other, which is disposed off the axis, is driven by means of an Oldham joint coupling maintaining at all times the relative angular orientation of the two disks. However, there is no sealing system between the fluid circuit and the mechanical drive.

An aim of the present invention is to propose a very compact machine with an absolute seal between the mechanical parts and the fluid circuit.

Accordingly, the invention consists in a scroll type fluid displacement machine including a fixed disk comprising a spiral working wall and a mobile disk equally comprising a spiral working wall cooperating with that of the fixed disk, means for driving circular translation movement of the mobile disk, a sealing bellows joined at one end to a member fixed with respect to the circular translation movement of the mobile disk and at its other end to a fixed part of the machine, said bellows separating the fluid circuit from the mechanical parts driving the mobile disk, characterized in that the fixed disk is joined on the side opposite the mobile disk to a fixed central shaft including a discharge passage, said central shaft being surrounded by said bellows, the space between said bellows and said fixed central shaft constituting a suction passage, in that a hollow main rotary shaft surrounds said bellows and is carried by at least one bearing in a fixed frame, one end of said main shaft including an eccentric circular bore cooperating with a drive member joined to the mobile disk, said drive means including an electric motor rotor joined to said main rotary shaft and surrounding it and a fixed stator surrounding said rotor.

One embodiment of the invention will now be described with reference to the accompanying drawings, in which.

Figure 1:
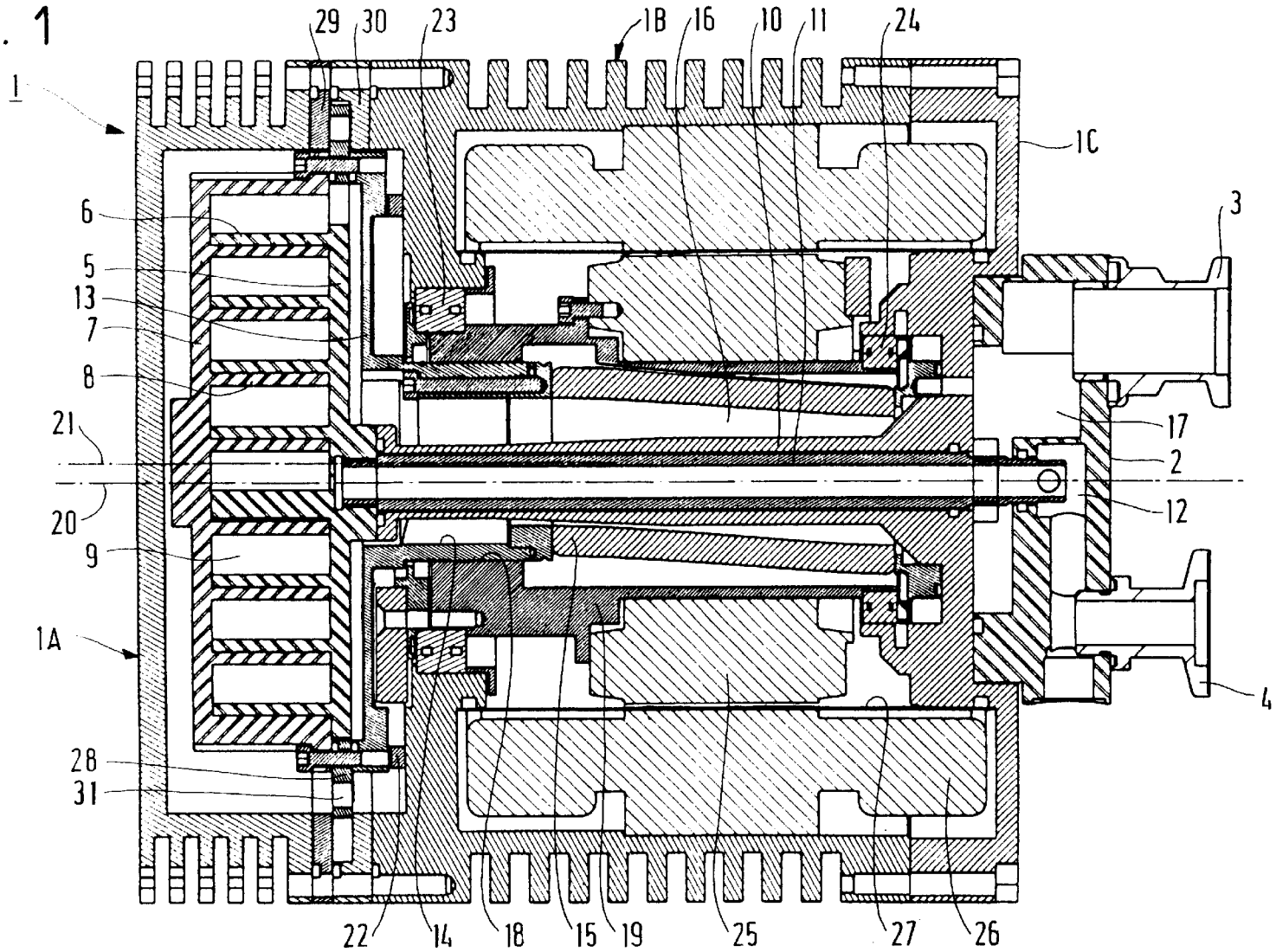
FIG. 1 represents a scroll type fluid displacement machine of the invention in axial section.

FIG. 1 shows a scroll type fluid type displacement machine of the invention. A machine of this kind is particularly well suited to use as a vacuum pump but can be used as a compressor or to pump a liquid. It comprises a fixed frame 1 in three parts assembled together: a casing 1A and a body in two parts 1B and 1C. A manifold 2 equipped with a suction flange 3 and a discharge flange 4 is fixed to the frame.

The frame encloses all of the machine and in particular its active pumping parts located inside the casing 1A and comprising a fixed disk 5 comprising a spiral wall 6 and a mobile disk 7 also comprising a spiral wall 8 cooperating with that of the fixed disk. With their disk the two spiral walls 6 and 8 delimit a working volume 9.

On the side opposite the mobile disk 7 the fixed disk 5 is joined to the frame 1 by a fixed central shaft 10 which, in the example described, is in one piece with the part 1C of the body of the frame 1. The fixed central shaft 10 is hollow and contains a discharge tube 11 leading into a discharge compartment 12 of the manifold 2 to which the discharge flange 4 is fixed.

Beyond its spiral wall 8 and around the fixed disk 5 the periphery of the mobile disk 7 is joined to the periphery of a connecting flange 13. With the mobile disk 7 the connecting flange 13 constitutes a fluid-tight casing enclosing the fixed disk 5. The central part of the flange 13 is open and the fixed central part 10 passes through it.

The central part of the flange 13 is joined to, or as in the figure is in one piece with, an eccentric hollow shaft 14 fixed and sealed to one end of a sealing bellows 15 surrounding the fixed central shaft 10 and the other end of which is fixed to the part 1C of the body of the frame 1.

The space 16 between the sealing bellows 15 and the fixed central shaft 10 constitutes a suction passage communicating with a suction compartment 17 of the manifold 2 to which the suction flange 3 is fixed.

The eccentric hollow shaft 14 is journaled in a bore 18 in a main rotary shaft 19 having an axis 20. The axis 21 of the bore 18 is eccentric to the rotation axis 20 of the main rotary shaft 19. Accordingly, in association with any kind of rotation preventing means, rotation of the main rotary shaft 19 causes circular movement in translation without rotation of the eccentric shaft 14 and therefore of the connecting flange 13 and the mobile disk 7.

In the example described rotation is prevented by an Oldham joint 22 between the connecting flange 13 and the part 1B of the body of the frame 1 which prevents rotation of the mobile disk 7 and its connecting flange 13.

The main rotary shaft 19 is hollow and surrounds the sealing bellows 15. It is supported by bearings 23 and 24 respectively mounted in the parts 1B and 1C of the body of the frame 1.

The main rotary shaft 19 is rotated by an electric motor the rotor 25 of which is joined to the shaft 19 and the stator 26 of which is joined to the frame 1. A tubular sealing jacket 27 separates the stator 26 from all the moving parts.

The axial position of the mobile disk 7 joined to the connecting flange 13 is precisely adjusted by a system with a shoe 28 rubbing between two lateral abutments 29, 30.

In the example shown in the figure the shoe 28 forms a circular ring joined to the casing 7–13 (mobile disk 7, connecting flange 13) and surrounding the casing externally and rubs between the two fixed lateral abutments joined to the frame 1: the abutment 29 and a spacer-abutment 30. The axial position of the mobile disk 7 is precisely adjusted by choosing the thickness of the spacer-abutment 30. The shoe 28 includes oil holes 31.

The contrary arrangement could be used: a fixed shoe joined to the frame 1 sandwiched between two lateral abutments joined to the mobile casing 7–13.

Because of the bellows 15 and the casing 7–13 enclosing the fixed disk 5, all of the pumping circuit from the suction flange 3 to the discharge flange 4 is completely isolated from and sealed with respect to all the mechanical parts such as the bearings 23, 24, the rubbing shoe type axial positioning device (disposed externally of the casing 7–13) and the eccentric shaft 14 journaled in the eccentric bore 18.

A machine of this kind is therefore perfectly suited to use as a clean and dry vacuum pump.

The mechanical parts mentioned above external to the fluid circuit are lubricated.

A machine of the above kind is highly compact and short. The precise axial positioning of the mobile disk relative to the fixed disk prevents any rubbing inside the pumping cell between a spiral wall and the opposite disk and therefore prevents the formation of particles that would otherwise be caused by any such rubbing.

Figure 2:
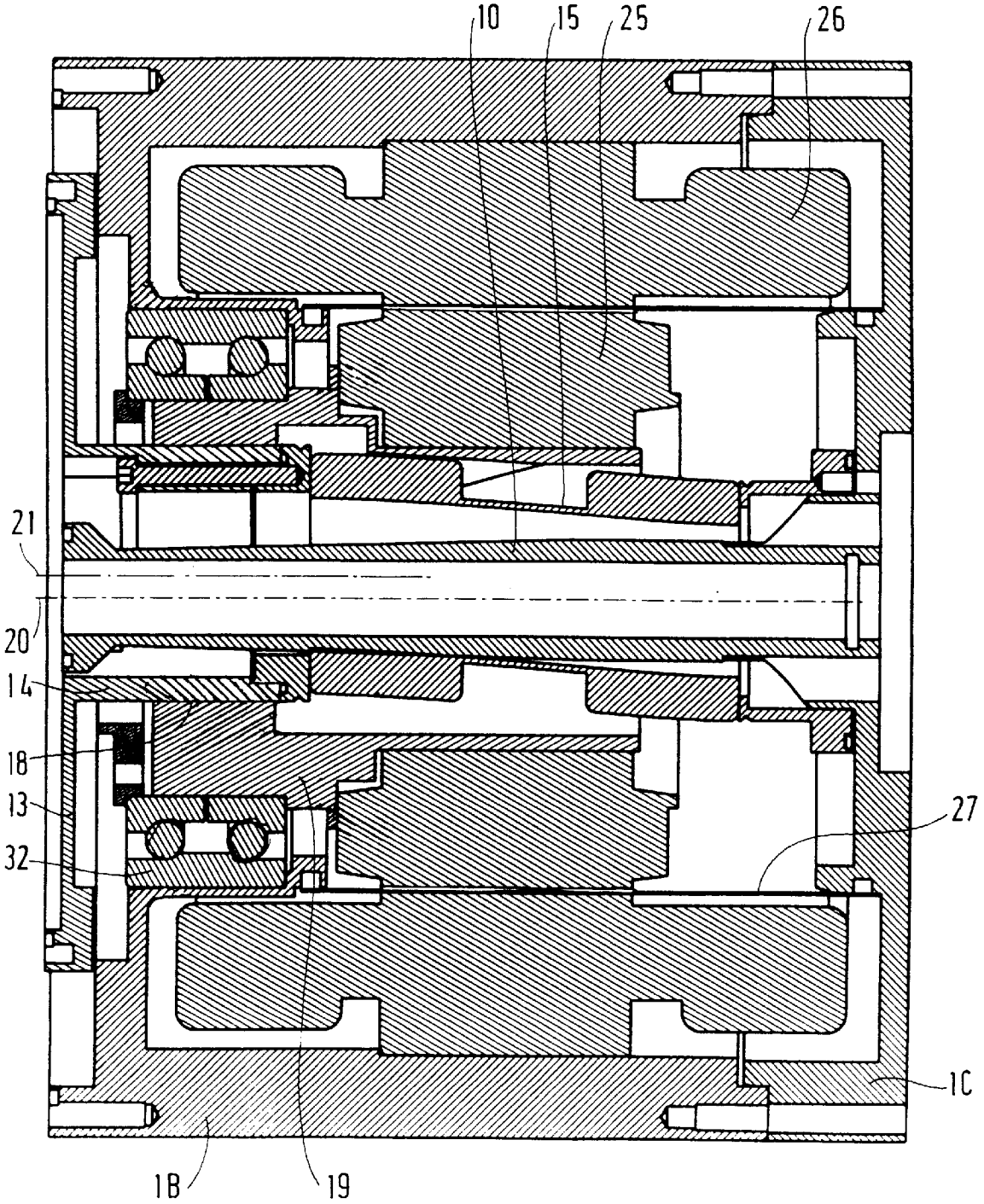
FIG. 2 is a partial view of a variant of the invention. This figure omits the active pumping part (fixed and mobile disks together with the casing enclosing them).

FIG. 2 is a variant in which, in contrast to FIG. 1, the main rotary shaft 19 is mounted cantilever fashion in a single prestressed bearing 32 with two rows of balls mounted in the part 1B of the body of the frame. This simplifies the pump. This figure omits the manifold 2, the casing 1A, the disks 5, 7 and the axial positioning device.

Figure 3:
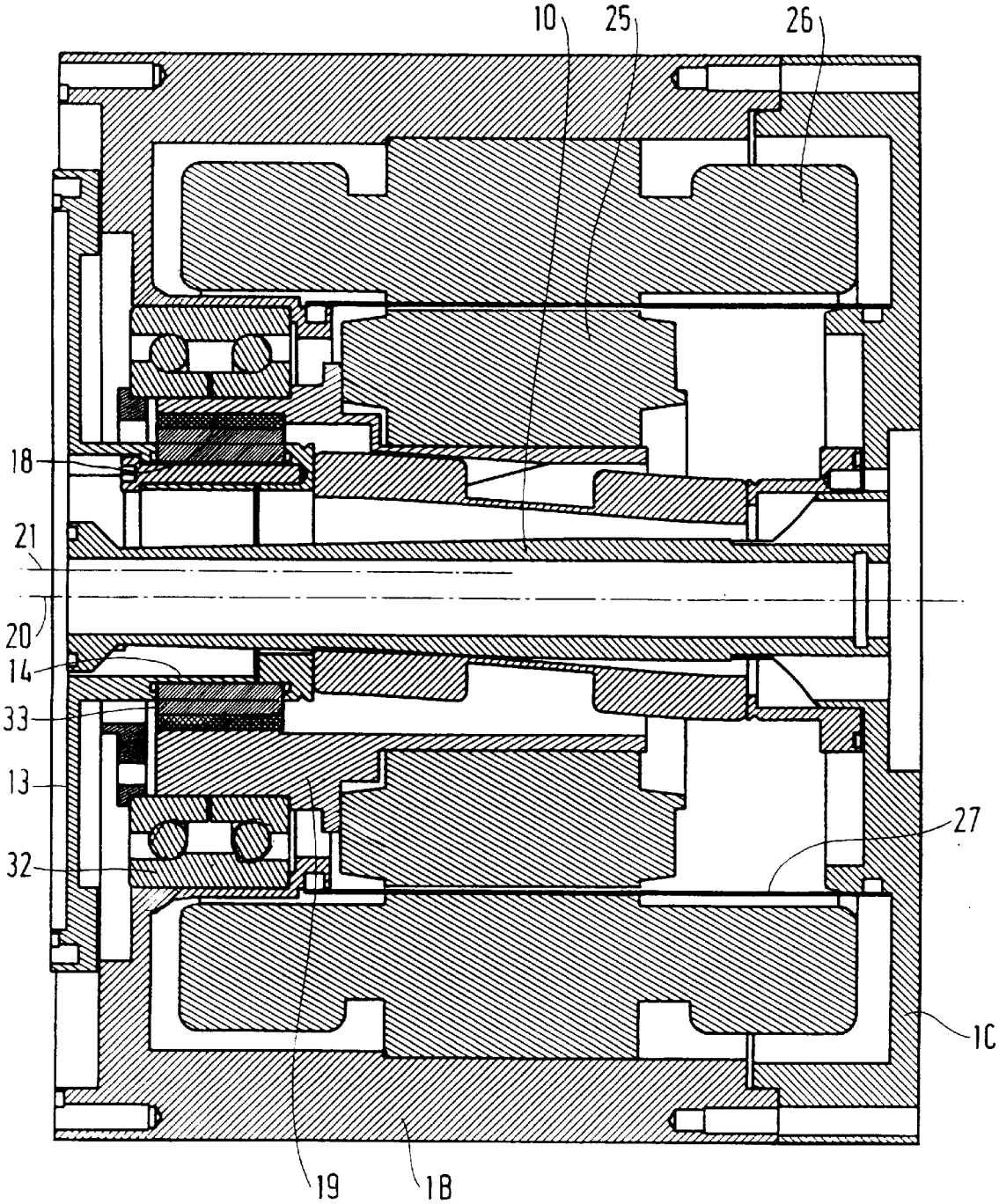
FIG. 3 is another variant, also omitting the active pumping part.

FIG. 3 is another variant in which, as in FIG. 2, the main rotary shaft 19 is mounted cantilever fashion in a single bearing 32; additionally, the eccentric hollow shaft 14 is mounted in the eccentric bore 18 having the axis 21 in the main rotary shaft 19 by means of a needle roller bearing 33.

It is claimed:

1. A scroll type machine including a fixed disk (5) comprising a spiral working wall (6) and a mobile disk (7) equally comprising a spiral working wall (8) cooperating with that of the fixed disk, means for driving circular translation movement of the mobile disk, a sealing bellows (15) joined at one end to a member (14) fixed with respect to the circular translation movement of the mobile disk (7) and at its other end to a fixed part (1C) of the machine, said bellows (15) separating the fluid circuit from the mechanical parts driving the mobile disk, characterized in that the fixed disk (5) is joined on the side opposite the mobile disk (7) to a fixed central shaft (10) including a discharge passage (11), said central shaft being surrounded by said bellows (15), the space (16) between said bellows and said fixed central shaft constituting a suction passage, in that a hollow main rotary shaft (19) surrounds said bellows (15) and is carried by at least one bearing (23, 24–32) in a fixed frame (1), one end of said main shaft (19) including an eccentric circular bore (18) cooperating with a drive member (14) joined to the mobile disk (7), said drive means including an electric motor rotor (25) joined to said main rotary shaft (19) and surrounding it and a joined stator (26) surrounding said rotor.

2. A machine according to claim 1 characterized in that a sealing jacket (27) separates the stator from the rotor of the drive motor.

3. A machine according to claim 1 characterized in that an Oldham joint (22) cooperates with a fixed part (1B) of the machine and with a part (13) undergoing said circular movement in translation to maintain a fixed angular orientation of the mobile disk (7) relative to the fixed disk (5).

4. A machine according to claim 1 characterized in that said drive member (14) is attached to a connecting flange (13) joined at its periphery around the fixed disk (5) to the mobile disk (7) beyond its spiral wall (8), the mobile disk (7) and the connecting flange (13) forming a casing enclosing the fixed disk (5).

5. A machine according to claim 4 characterized in that said casing (7–13) is axially positioned externally of the internal volume of said casing by a system with a shoe (28) rubbing between two axial abutments (29, 30), one of these members, i.e. the shoe or the axial abutments, being attached to the frame and the other to said casing (7–13).

6. A machine according to claim 4 characterized in that said drive member (14) and the connecting flange (13) are in one piece.

7. A machine according to claim 1 characterized in that said main rotary shaft (19) is supported cantilever fashion in said frame (1B) by a single bearing (32).

8. A machine according to claim 1 characterized in that said driving member (14) cooperates with said eccentric circular bore (18) through the intermediary of a roller bearing (33).

* * * * *